US005522647A

United States Patent [19]

Sartaine et al.

[11] Patent Number: 5,522,647

[45] Date of Patent: Jun. 4, 1996

[54] CONTINUOUS HIGHWALL MINING MACHINE WITH ARMLESS CONVEYOR

[75] Inventors: John J. Sartaine, Russell, Ky.; Jon C. Blackstock, Ironton, Ohio; John A. Baird, Jr., Flatwoods; Ian T. Carr, Ashland, both of Ky.

[73] Assignee: Mining Technologies, Inc., Ashland, Ky.

[21] Appl. No.: 328,642

[22] Filed: Oct. 25, 1994

[51] Int. Cl.[6] ..... E21C 35/20; E21D 9/12

[52] U.S. Cl. ..... 299/64; 198/314

[58] Field of Search ..... 299/64, 18, 67; 198/303, 314

[56] References Cited

U.S. PATENT DOCUMENTS

| | | | |
|---|---|---|---|
| 2,263,458 | 11/1941 | Gellatly | 198/728 |
| 2,724,517 | 11/1955 | Lewis | 414/523 |
| 3,154,190 | 10/1964 | Gonski | 198/570 |
| 3,190,697 | 6/1965 | Gonoki | 299/64 |
| 3,516,712 | 6/1970 | Bennett et al. | 299/64 |
| 3,651,923 | 3/1972 | Anderson et al. | 198/550.12 |
| 3,873,157 | 3/1975 | Stoltefuss et al. | 299/64 X |
| 4,588,071 | 5/1986 | Kleibohmer | 198/516 |
| 5,112,111 | 5/1992 | Addington et al. | 299/18 |
| 5,261,729 | 11/1993 | Addington et al. | 299/64 |

FOREIGN PATENT DOCUMENTS

| | | | |
|---|---|---|---|
| 2449459 | 4/1976 | Germany | 299/64 |
| 2827767 | 1/1980 | Germany | 299/64 |

*Primary Examiner*—David J. Bagnell
*Attorney, Agent, or Firm*—King & Schickli

[57] ABSTRACT

A continuous highwall mining machine includes a frame and a ground engaging loading shovel that is mounted to extend forwardly from the frame. A cutter for winning aggregate material is mounted to the frame so as to extend above and forwardly of the loading shovel. An armless conveyor system conveys aggregate material won from the mineral seam. The armless conveyor system includes twin chains having a forked section at the forwardmost end carried on the loading shovel and an uninterrupted straight path extending rearwardly from the forked section to a discharge end.

16 Claims, 4 Drawing Sheets

CONTINUOUS HIGHWALL MINING MACHINE WITH ARMLESS CONVEYOR

TECHNICAL FIELD

The present invention relates generally to the art of mining, and more particularly, to an improved mining machine adapted for utilization in a mining system for winning aggregate material such as coal from a mineral seam.

BACKGROUND OF THE INVENTION

A highwall mining system has recently been developed by Mining Technologies, Inc. and is generally described in, for example, U.S. Pat. Nos. 5,112,111 and 5,261,729 to Addington et al. Highwall mining is particularly useful where the coal seam is located at a significant depth below the surface and the amount of overburden that must be removed to reach the coal makes further strip mining economically unfeasible.

The highwall mining system includes a miner or mining machine for cutting material from the seam and a conveyor for conveying the won aggregate material from the mining machine for recovery. The conveyor is formed by a series of individual conveyor units that are coupled or interconnected in series so as to form a train. The last unit of the conveyor train is supported on a launch vehicle anchored to the bench outside the mine seam. The launch vehicle includes an underlying belly conveyor that receives aggregate material from the last unit of the conveyor train and delivers this material to a discharge conveyor.

In the past, the mining machine utilized in the highwall mining system has comprised a continuous miner of conventional design. Such a miner incorporates a gathering head including mechanically driven gathering arms or centripetal/centrifugal loading arms that feed the coal rearwardly to a chain conveyor. Such a gathering arm mechanism has a number of distinct disadvantages.

First, it should be appreciated that each of the components necessary to operate and drive the gathering arms consumes vertical space and effectively functions to increase the height profile of the mining machine thereby limiting its operational capabilities to relatively thick seams where the necessary clearance is provided. Second, the gathering arms require their own drive motor, gearing and related electrical devices that significantly increase costs associated with both production and maintenance.

Third, due to their location (i.e. in a lowermost position beneath the head that cuts the coal from the seam and adjacent the ground or floor), the gathering arm gear cases are susceptible to infiltration by water and mud/sand/grit resulting in contamination and damage. This leads to significant downtime for repairs. Fourth, these components also consume a significant amount of the available horizontal and vertical space between the pan of the gathering head and the boom of the overlying mill or drum-type cutting head. In fact, the drive mechanisms for the gathering arms serve to create a narrow throat or bottleneck that disadvantageously slows conveyance of won aggregate material and thereby limits conveyor system through-put or carrying capacity.

Fifth, because of the space required to accommodate the gathering arm drive mechanisms, the conveyor system must be positioned relatively rearwardly. Thus, the distance that the cut aggregate material must be moved for deposit into the conveyor is increased. This requires the provision of greater "storage capacity" in the gathering pan to accommodate the aggregate material during transfer and necessitates additional work from the arms resulting in a broken product and the production of unwanted fines and a loss of production. Sixth, because of the expense of providing a drive mechanism for the gathering arms, the conveyor is normally driven by the same drive. Thus, the loaded conveyor is pushed from the front end (i.e. the load is conveyed by the slack side of the chain). This reduces conveyor efficiency and, unfortunately adversely affects overall conveyor service life. Recognizing these shortcomings, a need is identified for a mining machine of improved design particularly adapted for utilization in a highwall mining system.

SUMMARY OF THE INVENTION

Accordingly, it is a primary object of the present invention to provide an improved mining machine of simple, inexpensive and reliable design that provides enhanced aggregate material cutting and carrying capacity in conjunction with significantly increased operating efficiency and lower operating costs.

Another object of the invention is to provide a mining machine that eliminates the need for the gathering arm mechanism and thereby provides the attendant advantages of a lower profile to allow operation in thinner seams and the elimination of constrictions to the conveyance path so as to allow completely efficient conveyance of the aggregate material being won from the mineral seam. Further, the resulting space savings allow more room for the utilization of larger cutter head motors and gear cases so that more horsepower may be provided for the cutting of coal as compared with conventional mining machines of similar height dimension.

Yet another object of the present invention is to provide a mining machine for continuous mining of a mineral seam incorporating a loading shovel including a scoop with sidewalls in conjunction with an armless conveying system comprising a twin chain conveyor for conveying aggregate material from the loading shovel to the rear of the mining machine. Advantageously, through the elimination of the gathering arm mechanism and related components it is possible to save space and thereby allow both wider and deeper conveyor flights to be utilized. As a result, the flow volume of the conveying system may be markedly enhanced to match the increased coal cutting capacity of the machine as just described so that the operator receives the full benefit of increased production provided by this innovative design.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved mining machine is provided for the continuous highwall mining of a mineral seam. The mining machine includes a frame having a front end and rear end. A loading shovel is mounted to the front end of the frame. The loading shovel includes a scoop with sidewalls. A rotating drum with picks is provided for winning aggregate material from the mineral seam. Preferably, the drum is carried on a pivotable boom mounted on the frame. The drum may also have a substantially barrel or arched shape: that is, a wider diameter at the midline than the lateral margins. This allows the seam to be cut with rounded angles at the corners of the cut thereby providing better roof support.

The mining machine also includes an armless mechanism for conveying aggregate material won from the mineral seam rearwardly from the loading shovel to the rear end of the frame. Further, the mining machine preferably includes a propelling mechanism and may, in fact, be self-propelled by means of a pair of traction motors operatively connected to a pair of crawler assemblies, one crawler assembly operatively mounted to each side of the frame. Accordingly, it should be appreciated that the mining machine may make use of a conventional drive mechanism well known in the art.

Advantageously, the mining machine of the present invention provides a number of distinctive advantages over conventional continuous miners. The mining machine incorporates a twin chain conveyor that extends from the loading shovel immediately adjacent the front lip thereof rearwardly to the rear end of the mining machine. The receiving or forwardmost end of the twin chain conveyor includes a forked section that has a deviation-from-centerline angle of between substantially 1°–60° and more preferably 20°–40°. This forked construction increases conveying efficiency by minimizing the residence time of aggregate material in the loading shovel. Further, prompt conveyance of the aggregate material resulting from the relatively forward position of the receiving end of the conveyor has the additional benefit of reducing the aggregate material storage volume required to be designed into the loading shovel since the material is rapidly removed by the twin chain conveyor and not allowed to accumulate. Accordingly, a lower overall profile may be provided to the shovel. Importantly, this allows for operation in relatively thinner seams.

It should further be appreciated that the drive motor for the twin chain conveyor is located on the frame of the mining machine not on the loading shovel. This positioning of the drive components reduces the overall weight of the loading shovel thereby reducing the frictional load of the shovel against the mine floor as the mining machine sumps forward. Thus, sumping force requirements are reduced and operating efficiency is improved.

The elimination of the drive components from the loading shovel also serves to create more free space for the rearward passage of the aggregate material. In fact, the individual flights of the twin chain conveyor may be made both wider and longer thereby significantly increasing conveyor capacity. Further, the twin chain conveyor extends rearwardly in an uninterrupted, straight path from the forked section to its discharge end. There are no corners, humps or dips to increase resistance to the flow of aggregate material and conveyor efficiency is thereby optimized. It should also be appreciated that all throats, constrictions and bottlenecks are eliminated by the strategic placement of the conveyor drive system at the rear of the machine and the elimination of the gathering arms and related drive mechanism as utilized on continuous miners of conventional design.

Further, it should be appreciated that the greater space or flow volume available for the movement of aggregate material both into and along the twin chain conveyor may be provided even while larger drive motors and gear cases are provided. These furnish increased horsepower to the drum for cutting aggregate material from the mineral seam. Further, these advantages may be provided while still maintaining an overall low profile for operation in relatively thin seams.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the inventor. In the drawing.

Reference will now be made in detail to the present preferred embodiment of the invention, an example of which is illustrated in the accompanying drawing.

DETAILED DESCRIPTION OF THE INVENTION

Figure 1:
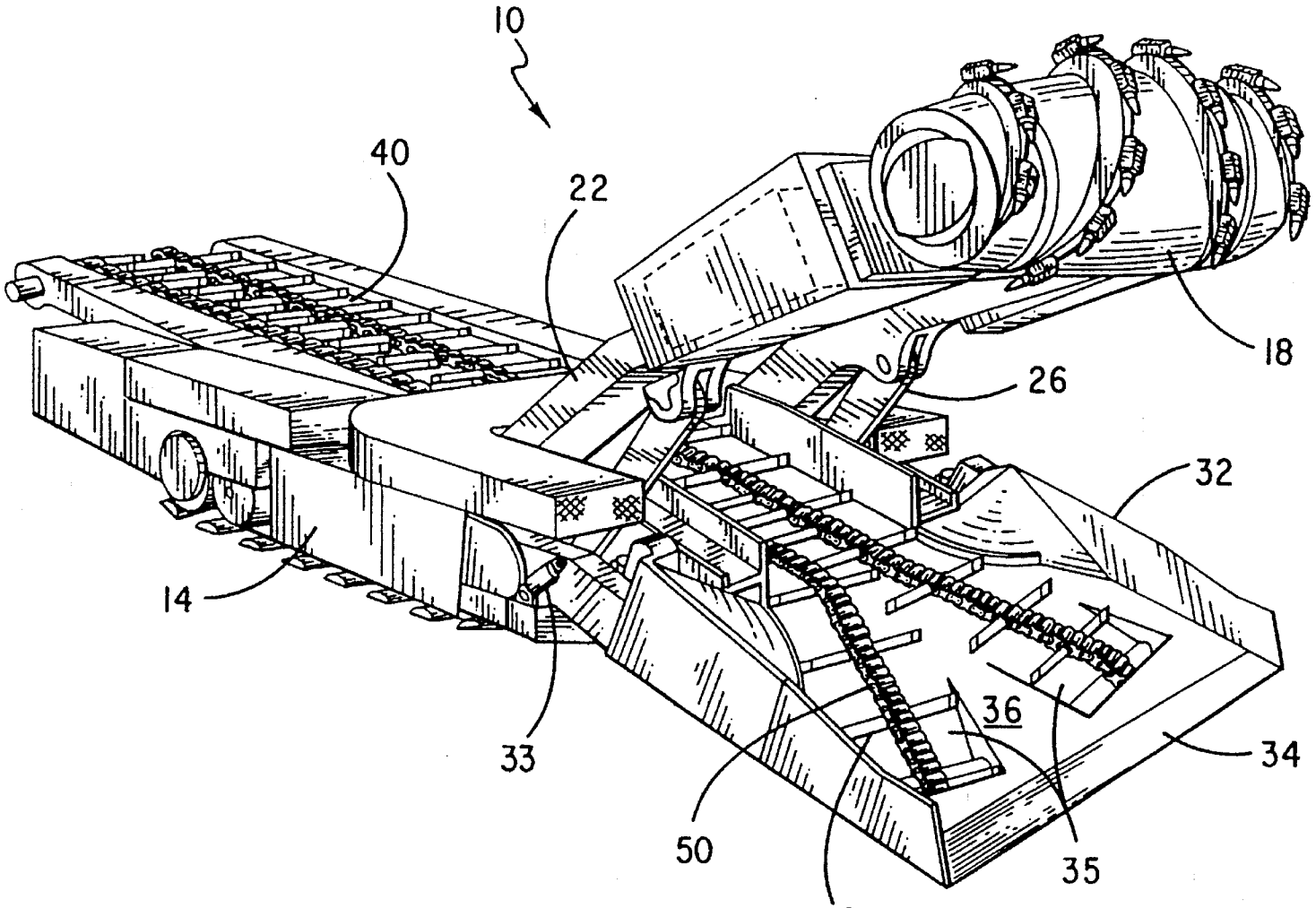
FIG. 1 is a perspective view of the mining machine of the present invention.
Figure 3:
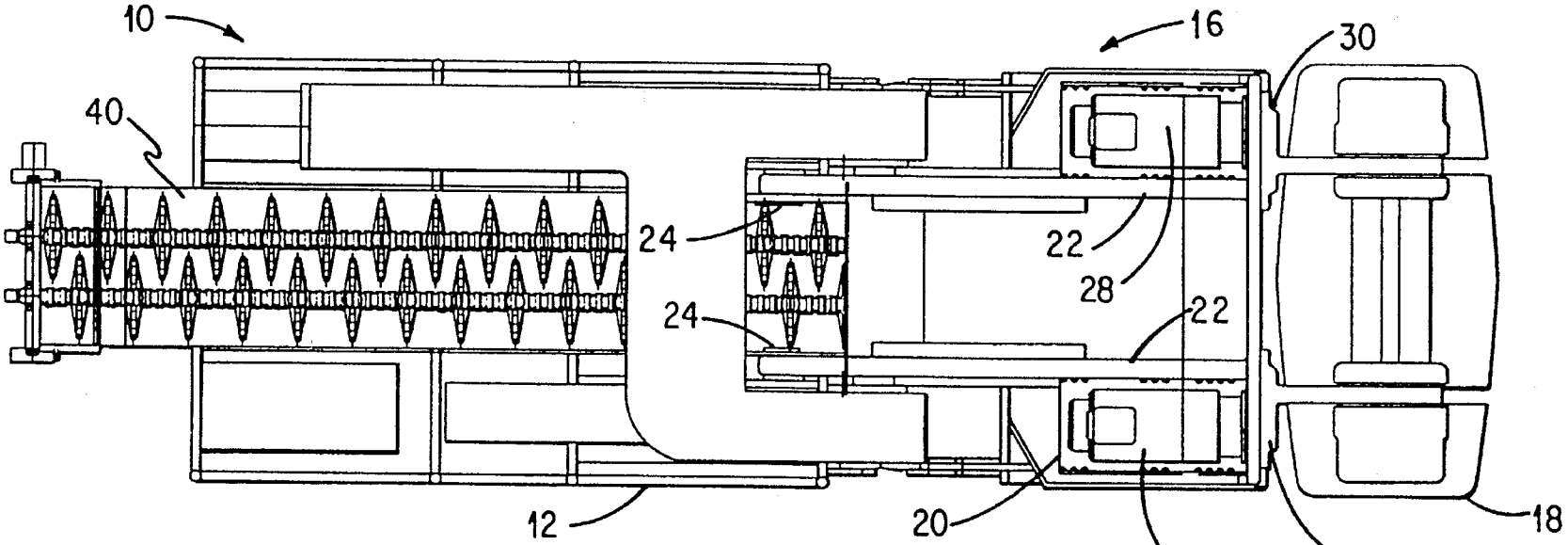
FIG. 3 is a top plan view of the mining machine.
Figure 2:
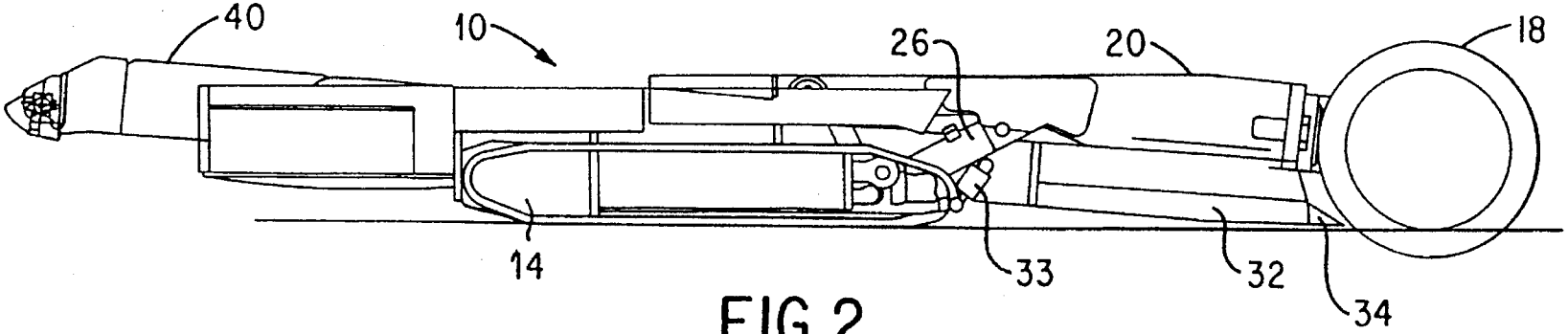
FIG. 2 is a side elevational view of the mining machine/ shown in FIG. 1.

Reference is now made to FIGS. 1–3 showing the mining machine 10 of the present invention for the continuous mining of a mineral seam. Such a mining machine may be utilized in a highwall mining system of the type described in, for example, U.S. Pat. Nos. 5,112,111 and 5,261,729 to Addington et al. owned by the assignee of the present invention. The full disclosure presented in these patent documents is incorporated herein by reference.

Advantageously, highwall mining systems of the type described allow for operation in thin seams to a depth of substantially 5–10 times greater than that possible with conventional auger mining. Since a large percentage of the remaining coal reserves around the world exists in relatively thin seams too low to mine with current underground methods and so situated to make surface mining impractical, highwall mining is expected to move to the forefront of coal recovery methods in the future.

As best shown in FIGS. 1, 2 and 3 the mining machine 10 includes a main frame 12 supported for moving or propelling relative to the ground by means of a pair of crawler assemblies 14, one on each side of the mining machine. These crawler assemblies 14 are powered by electric or hydraulic motors (not shown) carried on the frame 12 in a manner well known in the art.

The mining machine 10 also includes a means, generally designated by reference numeral 16, for winning aggregate material from the mineral seam. More particularly, the winning means comprises a three piece rotary cutter drum assembly 18 carried on the forward end of a boom 20 that is pivotally mounted to the frame 12. More specifically, as known in the art the cutter drum assembly 18 includes a series of picks (not shown) for ripping, breaking or cutting aggregate material from the mineral seam for subsequent recovery. The rotary cutter drum assembly 18 may be arched or substantially barrel shaped as shown so as to have a greater diameter at its midline than adjacent its lateral ends. In this way, the cutter drum assembly 18 cuts a bore hole with rounded corners at the sidewalls and roof of the bore hole. This resulting cut provides for better overall roof support.

The boom 20 includes a pair of spaced, lateral arms 22, each arm being pivotally mounted to the frame 12 through a trunnion 24. A pair of hydraulic actuators 26 (only one shown in the Figures) allow the selective angular positioning of the boom 20 relative to the frame 12. One actuator 26 is operatively connected between the frame 12 and each of the boom arms 22. As should also be appreciated, one motor 28 and cooperating gear case 30 are carried by each arm 22 to drive the cutter drum assembly 18. Accordingly, it should be appreciated that the cutter drum assembly 18 being described is of conventional design and operates in a conventional manner well known in the art.

Figure 4:
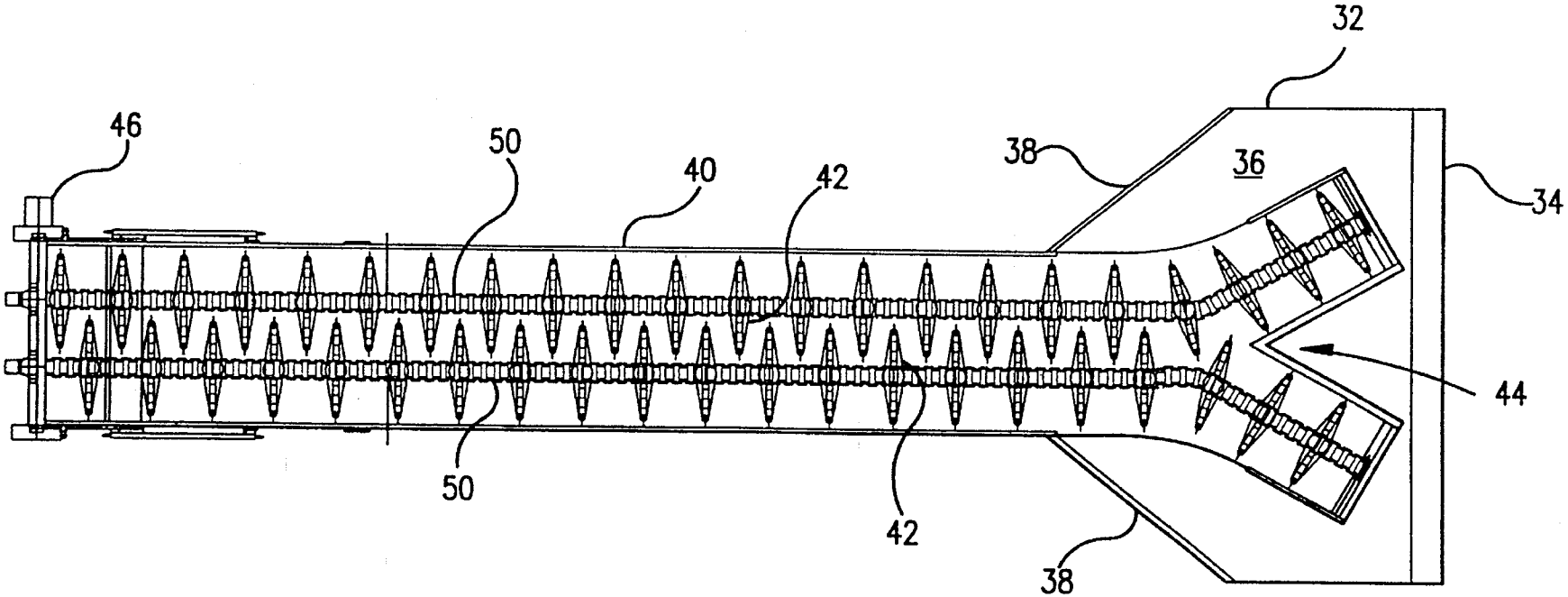
FIG. 4 is a detailed view of the loading shovel and twin chain conveyor mechanism of the mining machine.
Figure 5:
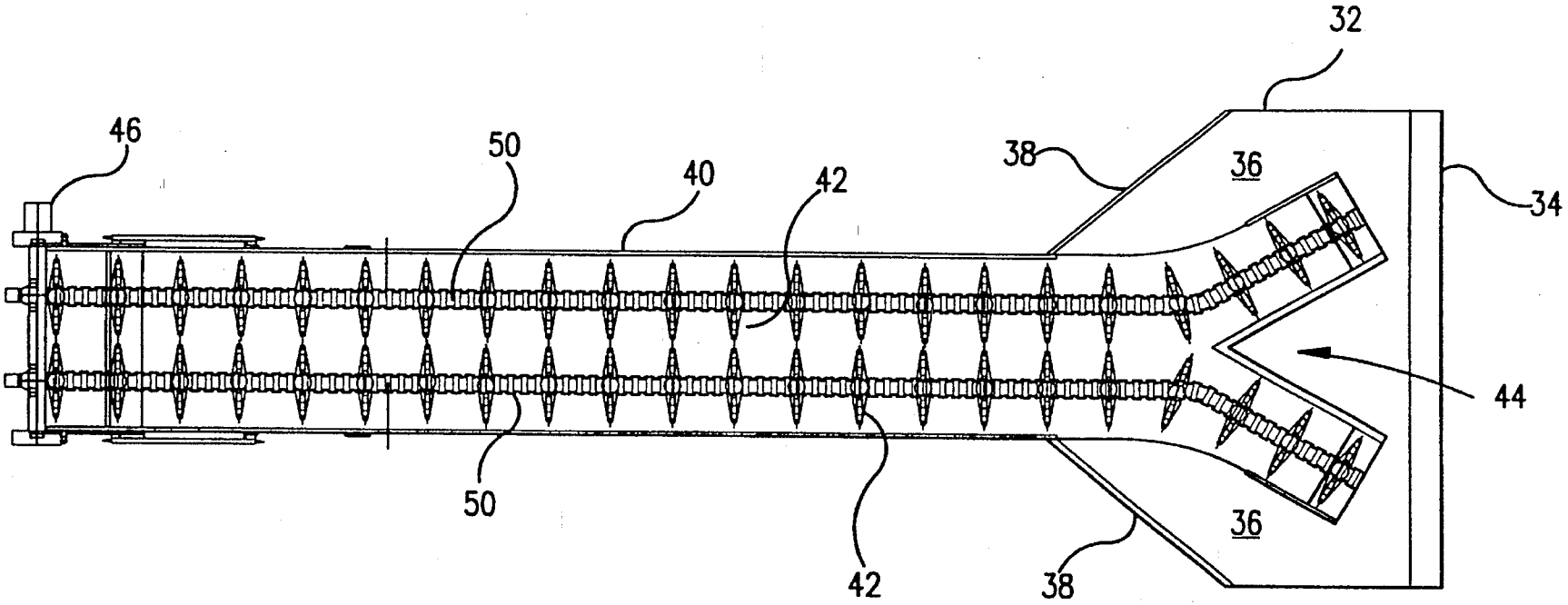
FIG. 5 is an alternative twin chain conveyor arrangement to that shown in FIG. 4.

As best shown in FIGS. 3–5, a loading shovel 32 is pivotally mounted to the front of the frame 12 so as to extend in a forward direction immediately below the boom 20 and below and behind the cutter drum assembly 18. The orientation of the loading shovel relative to the frame 12 is controlled by a pair of hydraulic actuators 33 mounted on the frame 12 (only one shown in the drawing figures). One actuator 33 is operatively connected to each side of the loading shovel 32.

The loading shovel 32 includes an inclined, reinforced lip 34, a floor pan 36 and a pair of cooperating sidewalls 38 that form a scoop. Of course, when a barrel shaped cutter drum assembly 18 is utilized, the lip 34 of the loading shovel 32 should be arched in profile to match the shape of the mine floor cut by the drum assembly.

As shown in FIGS. 4 and 5, a rear section of the sidewalls 38 converge toward a twin chain conveyor 40 as they extend in a rearward direction. As best shown in FIGS. 4, the twin chain conveyor 40 may include a series of interdigitating flights 42. Alternatively, as shown in FIG. 5, the flights 42 may be provided for operation in cooperative alignment.

As should be appreciated, the interdigitating flight conveyor 40 shown in FIG. 4 may include relatively larger flights that convey aggregate material from a larger surface area of the loading shovel 32 thereby reducing aggregate material residence time in the shovel and increasing carrying capacity of the conveyor. Alternatively, the aligned flight conveyor 40 shown in FIG. 5 has the advantage of relative ease of maintenance as the flights 42 are not interlaced. The particular design of the conveyor 40 utilized is simply a matter of determining which design has characteristics meeting the needs of the mine operator.

Whether the interdigitating flight conveyor 40 shown in FIG. 4 or the aligned flight conveyor 40 shown in FIG. 5 is utilized, it should be appreciated that a forked section 44 is provided at the forwardmost end of the conveyor so that the conveyor extends toward the outer corners of the loading shovel 32. In fact, the forked section 44 of the twin chain conveyor 40 has a deviation-from-centerline angle of between substantially 1°–60° and more preferably 20°–40°. This forked arrangement allows for a more efficient conveyance of aggregate material as it is cut from the mineral seam by the cutter drum assembly 18 and falls into the underlying loading shovel 32 during the advance of the mining machine 10.

In accordance with an important aspect of the present invention it should be appreciated that the cut aggregate material is conveyed rearwardly from the loading shovel to the rear end of the frame 12 on the conveyor 40 in a continuous and uninterrupted manner. Conveyor 40 extends in an absolutely straight path without any turns, humps or dips to interfere with the efficient conveyance of the aggregate material. Further, as a result of the present design, greater space or flow volume is available for the movement of material both into and along the conveyor 40. This is accomplished in two ways.

First, the hydraulic or electric drive motor 46 is provided at the rear or discharge end of the conveyor 40 opposite the loading shovel 32 where space is readily available to accommodate drive components. Further, the drive components are less likely to be contaminated with water and mud when housed in this position away from the mine floor. Still further, by driving at the discharge end, the motor 46 pulls the chains 50 from the load side thereby providing maximum operating efficiency and chain service life. As a further result, it is only necessary to provide sufficient space in the loading shovel for the relatively small return pulley (not shown) for each of the chains 50 of the conveyor 40. This results in significant space savings in the loading shovel 32 and increases the open space for movement of the aggregate material.

Second, the relatively low profile of the return pulley allows the receiving end of the conveyor 40 to be extended nearly to the lip 34 of the loading shovel 32. In effect, the conveyor 40 is made self-loading and there is no need to provide gathering arms or centripetal/centrifugal loading arms for moving coal into the conveyor 40 in accordance with continuous miners of conventional design. Through the elimination of the gathering arms and their associated gearing and drive motors from the area of the loading shovel 32, clearance for those mechanical components is no longer required and, accordingly, the pan may be lower in overall height and present a relatively low angle of rise. This reduces the work necessary to push the aggregate material into the conveyor 40.

Further open space is also provided for the flow of aggregate material which can then proceed unconstricted and uninterrupted in a far more efficient manner than possible in prior art equipment. Of course, the greater available space allows the individual flights 42 to be made both wider and deeper. Hence, the carrying capacity of the conveyor 40 is substantially increased over a conveyor on a conventionally designed machine of the same size that includes a gathering arm mechanism.

Other advantages also result from the forward placement of the conveyor 40 and the elimination of gathering arms. More specifically, actual aggregate material handling is reduced. This has the two-fold benefit of increasing the size consist of the aggregate product while reducing the production of fines that are a waste product of the coal cleaning process. Additionally, spillage is minimized. Spillage is a serious problem in conventional mining machines as the stirring action of the gathering arms results in a significant portion of the aggregate material being thrown from the gathering pan where it remains, unrecovered, on the mine floor.

In accordance with yet another important aspect of the present invention, it should be appreciated that the loading shovel 32 is of relatively low profile (note particularly FIG.

3). More specifically, the elimination of all haulage drive systems from the area of the loading shovel 32 reduces space and, therefore, height requirements necessary to accommodate the bulky components associated with such systems. Further, it should be appreciated that in a highwall mining process, one bore hole is cut between opposing sidewalls of the mineral seam. These seam walls cooperate with the loading shovel 32 and particularly the sidewalls 38 to direct cut aggregate material onto the conveyor 40. Of course, the presence of the mineral seam sidewalls means that the sidewalls 38 of the loading shovel 32 may also assume a relatively low profile.

Advantageously, the low profile of the loading shovel 32 allows the mining machine 10 to accommodate a boom 20 of an increased size or vertical dimension while still maintaining an overall height low or lower than possible with conventional mining equipment. Accordingly, the boom 20 may be outfitted with larger drive motors 28 and symmetrical gear cases 30 so as to provide more horsepower to the cutter drum assembly 18. As a result, aggregate material may be removed from the mineral seam at a faster rate. Advantageously, since the conveyor 40 also includes a receiving end adjacent the lip 34 for self-loading as well as deeper and wider flights 42, the faster cutting rate may also be accommodated by the conveyor system so that overall mining efficiency and therefore productivity is significantly enhanced.

Yet another advantage of the low profile loading shovel 32 is its ability to accommodate the operation of a straight or flat boom 20. More particularly, it is not necessary to provide a hump or arch in the boom 20 to provide the necessary clearance to lay over the loading shovel 32. Advantageously, the flat cutter boom 20 provides enhanced forward visibility through cameras (not shown) that allow for remote operation of the mining machine 10. Further, it should be appreciated that conventional miners incorporating arched or humped booms present an obstacle that may lead to the miner becoming trapped in the event of a roof fall. In contrast, the straight or flat boom 20 of the present mining machine 10 significantly reduces this possibility by eliminating the arch that otherwise serves as a catch point.

It should further be appreciated, that the elimination of all haulage drive systems from the loading shovel 32 significantly reduces the weight of the shovel. Accordingly, the frictional loading of the loading shovel 32 against the mine floor is significantly reduced as the miner sumps forward. Thus, again, it should be appreciated that improved operating efficiency is the beneficial result.

Still further, it should be appreciated that the low profile loading shovel 32 and the straight or flat boom 20 function in combination to provide all of these benefits while still further providing an overall lower profile mining machine 10 capable of operation in thinner seams. This is a significant advantage as most of the remaining coal reserves in the world today are in seams too thin to be mined by a conventional continuous miner.

In summary, numerous benefits result from employing the concepts of the present invention. The mining machine 10 of the present invention advantageously allows for the application of more powerful motors and stronger or higher rated gear boxes to power the cutter drum assembly 18 for the more efficient winning of aggregate material from the mineral seam. Increased conveyance capacity and efficiency is provided by moving the receiving end of the conveyor 40 forward so as to become self-loading, increasing the height and width of the conveyor flights 42 and removing bottlenecks and/or constrictions to flow. Together, the increased cutting capacity and increased conveying capacity compliment one another allowing the operator to receive the full benefits of the increases in performance.

The total elimination of the gathering arm mechanism also serves to significantly simplify the mechanical structure of the mining machine, reducing the necessary downtime to perform maintenance/service operations. Thus, in service or operation time is increased so as to provide an overall improvement in mining productivity relative to conventional continuous mining machines. Additionally, all of these benefits are achieved while allowing operation in relatively thinner seams. Thus, it should be appreciated that the mining machine of this invention represents a significant advance in the art.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, while the present invention has been described with reference to utilization in a highwall mining system, it can also be utilized in underground mining. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with breadth to which they are fairly, legally and equitably entitled.

We claim:

1. A mining machine for continuous highwall mining of a mineral seam, comprising:

a frame;

a ground engaging loading shovel mounted to extend forwardly from said frame;

a cutter for winning aggregate material from the mineral seam, said cutter extending above and forwardly of said loading shovel; and armless means for conveying the aggregate material won from the mineral seam said armless conveying means including a single twin chain conveyor having a forked section at a forwardmost end carried on said loading shovel for increasing conveying efficiency and lowering aggregate material residence time in said loading shovel.

2. The mining machine set forth in claim 1, further including a means for propelling said mining machine.

3. The mining machine set forth in claim 2, wherein said propelling means comprises a pair of crawler assemblies operatively connected to a pair of traction motors all mounted to said frame.

4. The mining machine set forth in claim 2, wherein said cutter is a rotating drum having picks for cutting aggregate material from the mineral seam.

5. The mining machine set forth in claim 4, wherein said rotating drum is carried on a boom mounted to said frame.

6. The mining machine set forth in claim 4, wherein said rotating drum has a substantially barrel shape for cutting a floor and roof having an uninterrupted arched profile.

7. The mining machine set forth in claim 4, wherein said propelling means comprises a pair of crawler assemblies operatively connected to a pair of traction motors all mounted to said frame.

8. The mining machine set forth in claim 1, wherein said loading shovel includes a scoop having a floor pan and sidewalls that converge rearwardly toward said armless conveying means.

9. The mining machine set forth in claim 8, wherein said armless conveying means includes a drive motor located on said frame.

10. The mining machine set forth in claim 9, wherein said forked section of said twin chain conveyor has a deviation-from-centerline angle of between substantially 20°–40°.

11. The mining machine set forth in claim 10, wherein said cutter is a rotating drum having picks for tearing aggregate material from the mineral seam.

12. The mining machine set forth in claim 11, wherein said rotating drum is carried on a boom mounted to said frame.

13. The mining machine set forth in claim 11, wherein said rotating drum has a substantially barrel shape for cutting a floor and roof having an uninterrupted arched profile.

14. The mining machine set forth in claim 1, wherein said twin chain conveyor extends rearwardly from said loading shovel in an uninterrupted, straight path from said forked section to a discharge end.

15. The mining machine set forth in claim 1, wherein said armless conveying means includes a drive motor located on said frame.

16. The mining machine set forth in claim 15, wherein said forked section of said twin chain conveyor has a deviation-from-centerline angle of between substantially 20°–40°.

* * * * *